US006347952B1

(12) United States Patent
Hasegawa et al.

(10) Patent No.: US 6,347,952 B1
(45) Date of Patent: Feb. 19, 2002

(54) CONNECTOR WITH LOCKING MEMBER AND AUDIBLE INDICATION OF COMPLETE LOCKING

(75) Inventors: Teruaki Hasegawa; Kiyotaka Kawase, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/663,877

(22) Filed: Sep. 15, 2000

(30) Foreign Application Priority Data

Oct. 1, 1999 (JP) ..... 11-281841

(51) Int. Cl.[7] ..... H01R 13/627
(52) U.S. Cl. ..... 439/352
(58) Field of Search ..... 439/352, 354, 439/357, 489

(56) References Cited

U.S. PATENT DOCUMENTS 4,915,643 A 4/1990 Samejima et al.
5,041,017 A * 8/1991 Nakazato et al. ..... 439/509
5,183,410 A * 2/1993 Inaba et al. ..... 439/489
5,364,283 A 11/1994 Katoh et al.
5,643,003 A 7/1997 Myer et al.
5,820,399 A * 10/1998 Shirouzu et al. ..... 439/352
5,947,763 A * 9/1999 Alaksin ..... 439/489

FOREIGN PATENT DOCUMENTS

EP 0 501 237 9/1992

* cited by examiner

*Primary Examiner*—Brian Sircus
*Assistant Examiner*—Brian S. Webb
(74) *Attorney, Agent, or Firm*—Anthony J. Casella; Gerald E. Hespos

(57) ABSTRACT

A connector includes first and second housings (10; 20). A lock arm (27) is formed on the second housing (20) and includes a lock (30) and striking portions (31). The lock (30) moves onto a locking projection (13) of the first housing (10) during a connecting operation and engages the locking projection (13) when the housings (10; 20) are connected properly. The striking portions (31) are formed separately from the lock (30) and produce a sound upon striking upon the first housing (10) when the housings (10; 20) are connected properly with each other. Since the striking portions (31) or producing a striking sound and the lock (30) for locking are separately formed, a vertical dimension of an engaging area of the lock (30) with the locking projection (13) can be reduced to suppress a degree of elastic deformation of the lock arm (27) while securely producing the striking sound.

8 Claims, 6 Drawing Sheets

CONNECTOR WITH LOCKING MEMBER AND AUDIBLE INDICATION OF COMPLETE LOCKING

BACKGROUND OF THE INVENTION

1. Field of the Invention

The present invention relates to a connector provided with a locking function.

2. Description of the Related Art

A known connector with a locking function is disclosed in Japanese Unexamined Patent Publication No. 6-20740, and also is shown in FIGS. 7 and 8 herein. The prior art connector of FIGS. 7 and 8 includes first and second housings 101 and 103. A locking projection 102 is formed on the upper surface of the first housing 101 and a lock arm 104 is formed on the upper surface of the second housing 103. The lock arm 104 can be deformed elastically to move over the locking projection 102 as the housings 101 and 103 are being connected. However, the lock arm 104 is restored elastically to its original shape when the housings 101 and 103 are connected properly. A locking portion 104A is formed at the leading end of the lock arm 104 and engages the locking projection 102 to lock the housings 101 and 103 together, as shown in FIG. 8. The bottom end of the locking portion 104A strikes the upper surface of the mating housing 101 with a sound upon the elastic restoration of the lock arm 104. This striking sound informs the operator that the lock arm 104 has locked the housings 101 and 103 together.

In the above-described prior art connector, as the height of the locking projection 102 increases, a projecting distance of the locking portion 104A is lengthened accordingly so that the locking portion 104A can strike the upper surface of the mating housing 101. However, as the projecting distance of the locking portion 104A increases, a degree of elastic deformation of the lock arm 104 also increases. As a result, a connection resistance resulting from the elastic force of the lock arm 104 disadvantageously increases.

The present invention was developed in view of the above problem, and an object thereof is to reduce a degree of elastic deformation of a lock arm while maintaining a striking sound at the completion of a locking operation.

SUMMARY OF THE INVENTION

The subject invention is directed to a connector that comprises first and second housings that are at least partly connectable with each other. A locking projection is formed on the first housing and a lock arm is formed of the second housing. The lock arm contacts the locking projection during connection of the housings and deforms elastically to pass the locking projection. The lock arm then is restored elastically substantially to its original shape to engage the locking projection and to lock the housings together. This elastic restoration causes the lock arm to strike the second housing and to produce a striking sound when the housings are connected properly with each other.

The lock arm comprises a lock for interfering with the locking projection and generating deflection of the lock arm during the connection of the housings. The lock then engages the locking projection when the housings are connected properly with each other.

At least one striking portion is located in a non-interfering position where it does not interfere with the locking projection. The striking portion is dimensioned and disposed to strike one of the housings when the housings are properly connected with each other. A projecting distance of the locking portion is set shorter than that of the striking portion.

The striking portion and the lock are at separate locations, and the projecting distance of the lock is smaller than the projecting distance of the striking portion. Thus, a degree of elastic deformation of the lock arm can be decreased to reduce a connection resistance resulting from an elastic force of the lock arm without reducing the ability to produce a striking sound.

Preferably, two striking portions are formed substantially symmetrically with respect to the longitudinal axis of the lock arm. The symmetrical disposition of the striking portions prevents a twisting deformation at the time of striking.

The striking portion preferably is substantially continuous with the lock. The continuous formation of the locking and striking portions prevents deformation of the lock in response to forces that act in directions to separate the housings.

According to a further preferred embodiment, the projecting distance of the lock is set such that the lock arm interacts only with an upper portion of the locking projection. As a result, the displacement of the lock arm caused by interaction with the locking projection is reduced. Accordingly, a connection resistance resulting from the elastic restoring force of the lock arm is reduced.

The connector may further comprise a slider that is movable in the second housing. The slider restricts movement of the lock arm, when the slider is in a displacement restricting position, but allows movement of the lock arm, when the slider is in a displacement permitting position. The slider may have a flexible wall for contacting the lock arm to effect an unlocking of the lock arm, when the slider is moved to the displacement permitting position and when the two housings are locked.

Most preferably, the connector further comprises biasing means for biasing the two housings in a disengaging direction with respect to each other.

These and other objects, features and advantages of the present invention will become apparent upon reading of the following detailed description of preferred embodiments and accompanying drawings.

DETAILED DESCRIPTION OF THE PREFERRED EMBODIMENT

Figure 1A:
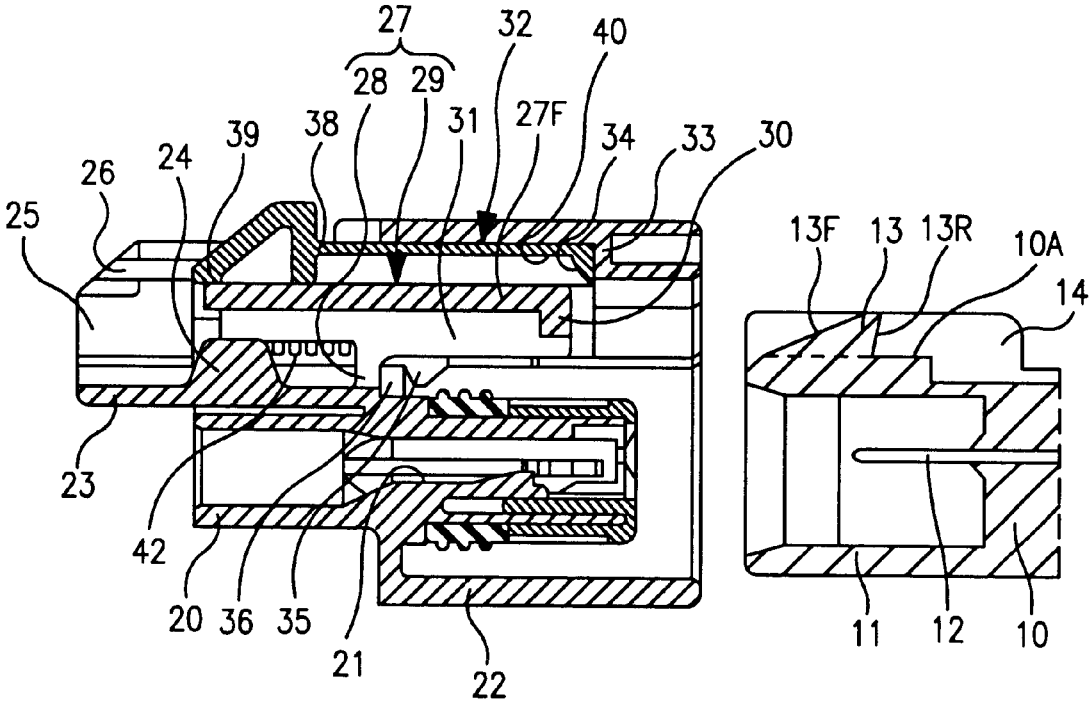
FIG. 1A is a section showing a state of a lock arm when female and male housings are separate from each other.

A connector in accordance with the subject invention is illustrated in FIGS. 1 to 6, and includes a male housing 10 and a female housing 20. The female housing 20 is provided with one or more female terminal fittings and a slider 32. The male housing 10 is provided with one or more male terminal fittings 12. The housings 10 and 20 can be connected with each other and separated from each other. In the description of this embodiment, the sides of the housings 10 and 20 that face each other when they are connected are referred to as the front sides, and the vertical direction is based on the orientation shown in FIGS. 1 to 5.

The male housing 10 has a receptacle 11 that opens forwardly, and the male terminal fittings 12 are exposed substantially side by side in the receptacle 11. A locking projection 13 is formed on an upper surface 10A of the male housing 10 and substantially in the middle with respect to a widthwise or transverse direction. The front surface of the locking projection 13 defines a slanted guide surface 13F, which is inclined down to the front. The rear of the locking projection defines a locking surface 13R, which is inclined slightly with respect to a direction that is normal to the connecting direction of the housings 10 and 20. The locking surface 13R is inclined to extend obliquely backward from its bottom end to its upper end, and thus overhangs with respect to the upper surface 10A of the male housing 10. With this configuration, the locking projection 13 has a substantially triangular cross section when viewed sideways. Pushing portions 14 are formed at the respective opposite sides of the locking projection 13, and preferably are in the form of ribs that extend substantially parallel to the connecting direction.

The female housing 20 includes side-by-side cavities 21 for at least partly accommodating female terminal fittings (not shown). A tubular engaging portion 22 substantially surrounds a front portion of the female housing 20 and is spaced therefrom. The rear end of the tubular engaging portion 22 is continuous with the outer surface of the female housing 20 at its left and right side edges and its bottom edge. Accordingly, a space penetrates the female housing 20 in the longitudinal or forward and backward directions between the upper surface of the female housing 20 and the engaging portion 22. A projecting wall 23 extends substantially backward and is formed to be continuous and flush with the upper surface of the female housing 20. An excessive deformation restricting projection 24 is formed on the upper surface of the projecting wall 23 for restricting an excessive deformation of a lock arm 27 beyond its limit of elasticity. The lock arm 27 is described further below. Guide walls 25 stand on the opposite side edges of the projecting wall 23, and guide grooves 26 are formed in the inner surfaces of the guide walls 25 for movably guiding the slider 32 in forward and backward directions.

Figure 4A:
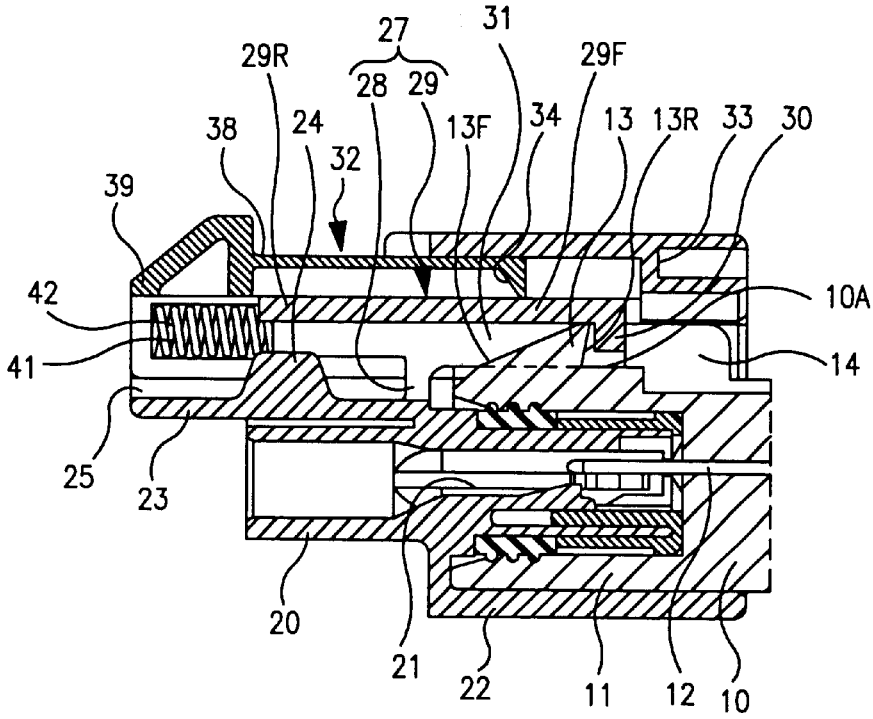
FIG. 4A is a section showing a state of the lock arm when the connection of the housings is completed.
Figure 4B:
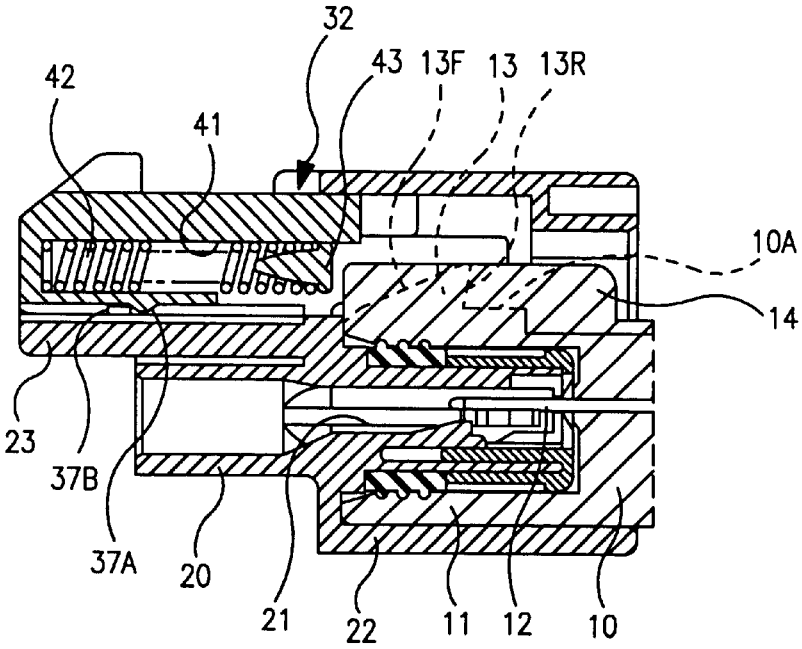
FIG. 4B is a section showing a state of the compression coil springs when the connection of the housings is completed.
Figure 5:
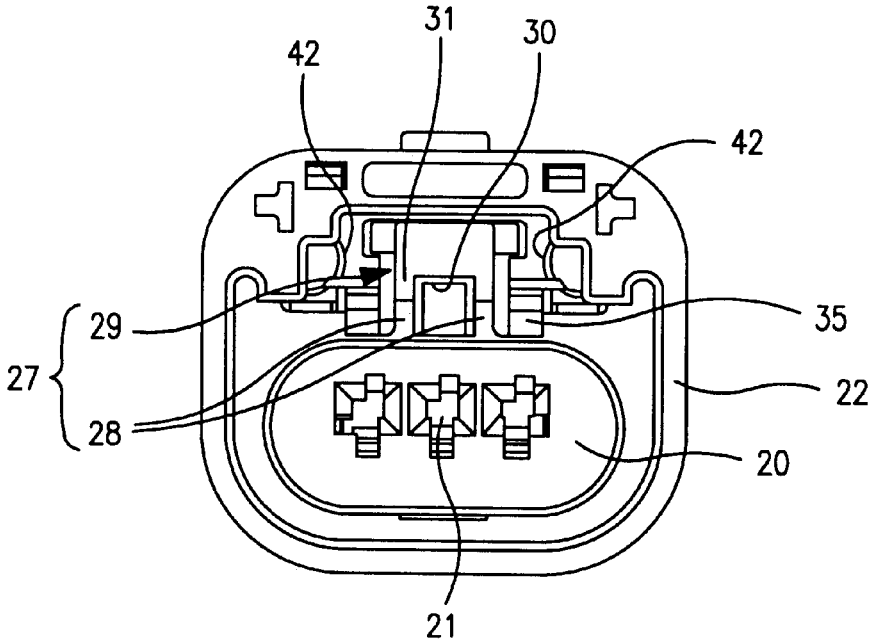
FIG. 5 is a front view of the female housing.
Figure 6:
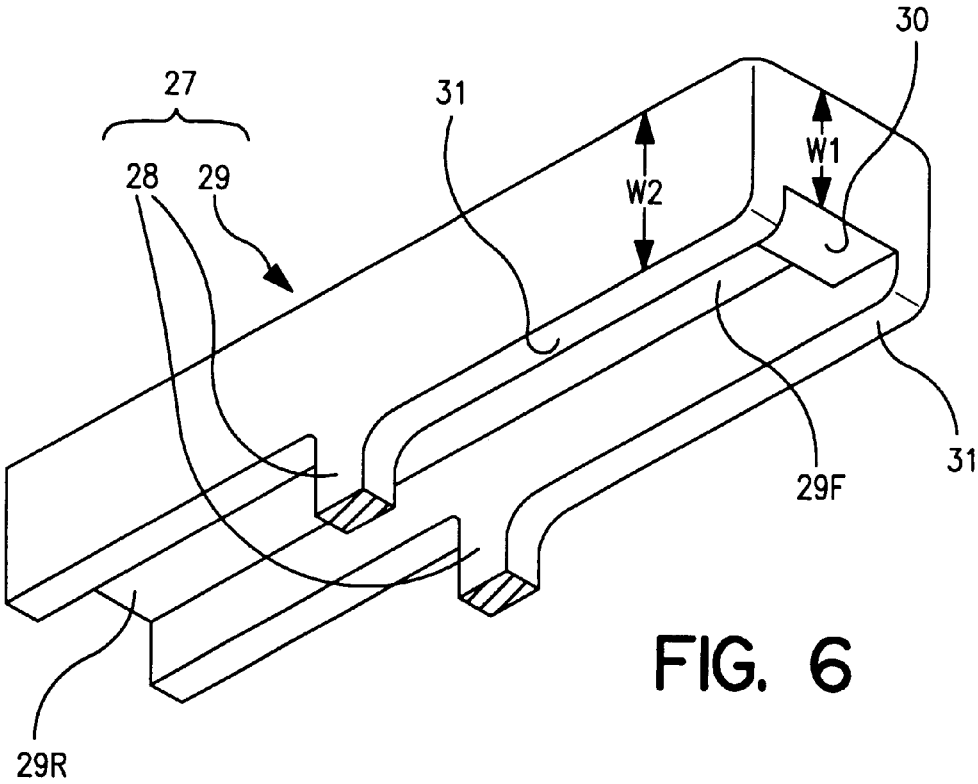
FIG. 6 is a perspective view of the lock arm.
Figure 7:
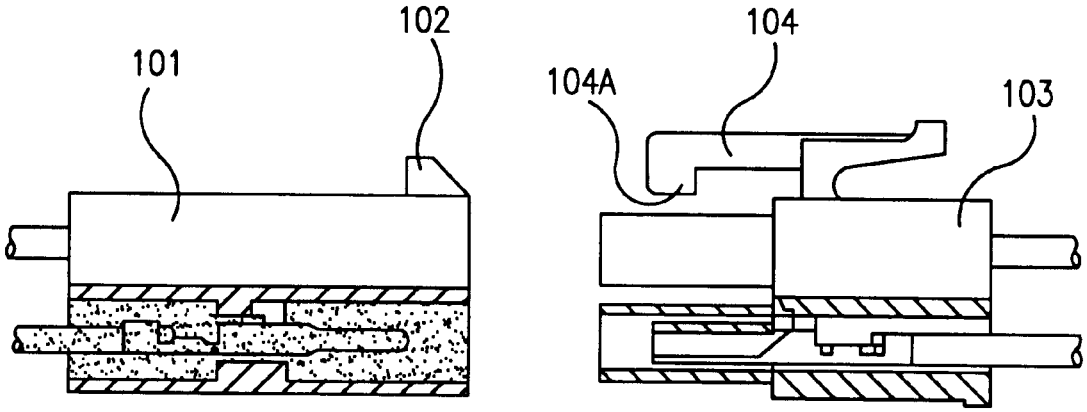
FIG. 7 PRIOR ART
FIG. 7 is a section of a prior art connector in its separated state.
Figure 8:
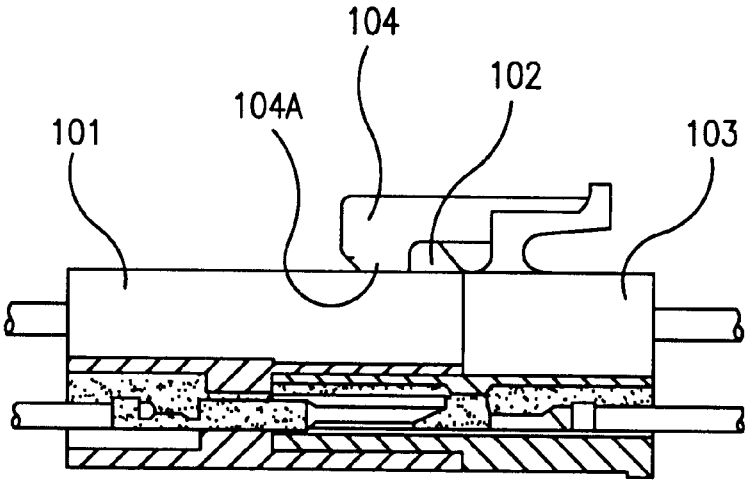
FIG. 8 PRIOR ART
FIG. 8 is a section of the prior art connector in its connected state.

The lock arm 27 is integrally or unitarily formed on the upper surface of the female housing 20, and comprises left and right legs 28 that project substantially in the middle of the female housing 20 with respect to forward and backward directions. An inclinable displacing portion 29 bridges the upper ends of the legs 28 and extends forward and backward from the legs 28. A section of the displacing portion 29 before or in front of the legs 28 serves as a locking portion 29F and a section of the displacing portion 29 behind the legs 28 serves as an unlocking portion 29R, as shown in FIG. 4. In a natural state, where no force acts, the displacing portion 29 is substantially parallel to the upper surface of the female housing 20, and hence, substantially parallel to the connecting and separating directions of the housings 10 and 20. This parallel unbiased orientation of the displacing portion 29 is referred to as the locking position. While the housings 10 and 20 are being connected or separated, the displacing portion 29 is displaced elastically to an unlocking position where the locking portion 29F is displaced upward.

A lock 30 projects down along the front edge of the locking portion 29F, and striking portions 31 project down from the left and right edges of the locking portion 29F. The striking portions 31 preferably are in the form of narrow ribs that extend from the front end of locking portion 29F to the legs 28. Additionally, the striking portions 31 are substantially symmetrical with respect to a longitudinal axis of the displacing portion 29, which is a line substantially parallel to the connecting directions of the housings 10 and 20. Front ends of the striking portions 31 are continuous with the side edges of the lock 30. A downward projecting distance or width W2 of the striking portions 31 is set such that the striking portions 31 can strike the upper surface 10A of the male housing 10 when the lock arm 27 properly locks the housings 10 and 20 with each other. A downward projecting distance or width W1 of the lock 30 is less than the width W2 of the striking portions 31. The width W1 of the lock 30 also is set such that the lock 30 interferes with the slanted guide surface 13F of the locking projection 13 while the housings 10 and 20 are being connected with each other, and preferably engages substantially an upper half of the locking surface 13R of the locking projection 13 from behind when locking by the lock arm 27 is effected.

The slider 32 is provided in a space between the upper surface of the female housing 20 and the engaging portion 22, and is movable forward and backward with respect to the female housing 20 by fitting its left and right guidable portions (not shown) into the guide grooves 26.

The slider 32 can be moved to a displacement permitting position at the front end of a moving path of the slider 32. However, any further forward movement of the slider 32 is stopped by contact of the front end of the slider 32 with the inner wall of the engaging portion 22. Deflection of the lock arm 27 to the unlocking position is permitted when the slider 32 is in the displacement permitting position because a restricting projection 34 at the front end of the slider 32 is located more forward than the front end of the lock arm 27. The slider 32 is prevented from loosely moving from the displacement permitting position toward a displacement restricting position by engagement of an elastic holding piece 35 on its lower surface with a receiving portion 36 of the female housing 20. When the male housing 10 approaches a proper connection with the female housing 20, the front upper edge of the male housing 10 elastically displaces the elastic holding piece 35 in a disengaging direction from the receiving portion 36. Thus, the slider 32 is permitted to move to the displacement restricting position.

A locking projection 37A is formed on the lower surface of the slider 32 and engages a stopper 37B of the projecting wall 23, as shown in FIG. 4, to stop backward movement of the slider 32 beyond the displacement restricting position at the rear end of the moving path. With the slider 32 in the displacement restricting position, the restricting projection 34 is located in a position to press or interact with the upper surface of the locking portion 29A of the lock arm 27 in the locking position, thereby preventing the lock arm 27 from inclining toward the unlocking position.

A flexible wall 38 cantilevers backward from a center area of the slider 32 with respect to widthwise direction, and is elastically deformable upwardly and downwardly. The rear end of the flexible wall 38 is formed with a pushing portion 39 that substantially contacts the upper surface of the unlocking portion 29R of the lock arm 27 when the lock arm 27 is in the locking position and when the slider 32 is in the displacement permitting position. Further, a deformation permitting space 40 is defined between the flexible wall 38 and the upper surface of the lock arm 27 for permitting the inclined displacement of the lock arm 27 toward the unlocking position.

Spring chambers 41 with open front walls are formed at the opposite respective sides of the deformation permitting space 40 with respect to the widthwise direction of the slider 32. Compression coil springs 42 are accommodated in the respective spring chambers 41 such that the longitudinal axis of each spring 42 extends substantially parallel to longitudinal or forward and backward directions, which are the connecting and disconnecting directions of the housings 10 and 20. The rear ends of the coil springs 42 are fixed in the spring chambers 41 by unillustrated locking means, and spring washers 43 are mounted at the front ends of the coil springs 42.

Figure 1B:
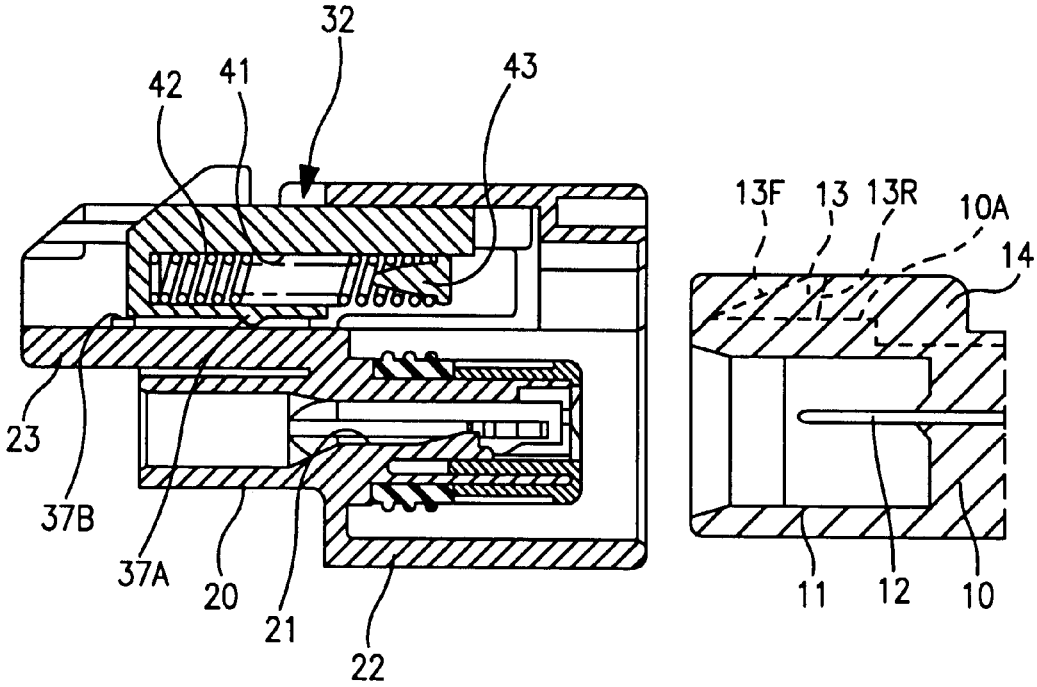
FIG. 1B is a section showing a state of compression coil springs when the housings are separate from each other.
Figure 2A:
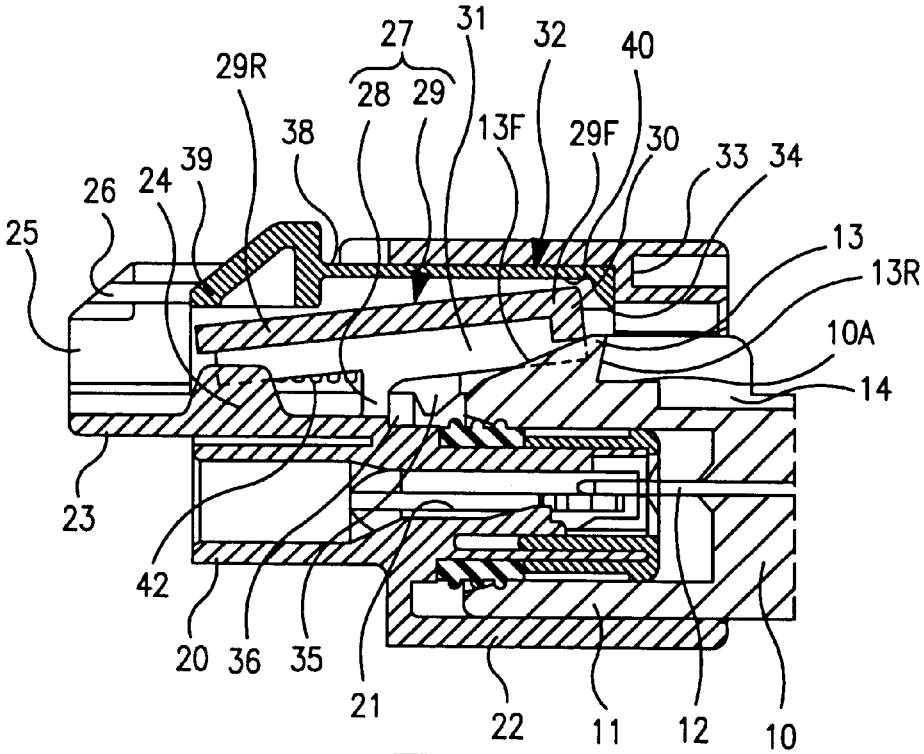
FIG. 2A is a section showing a state of the lock arm while the housings are being connected with each other.
Figure 2B:
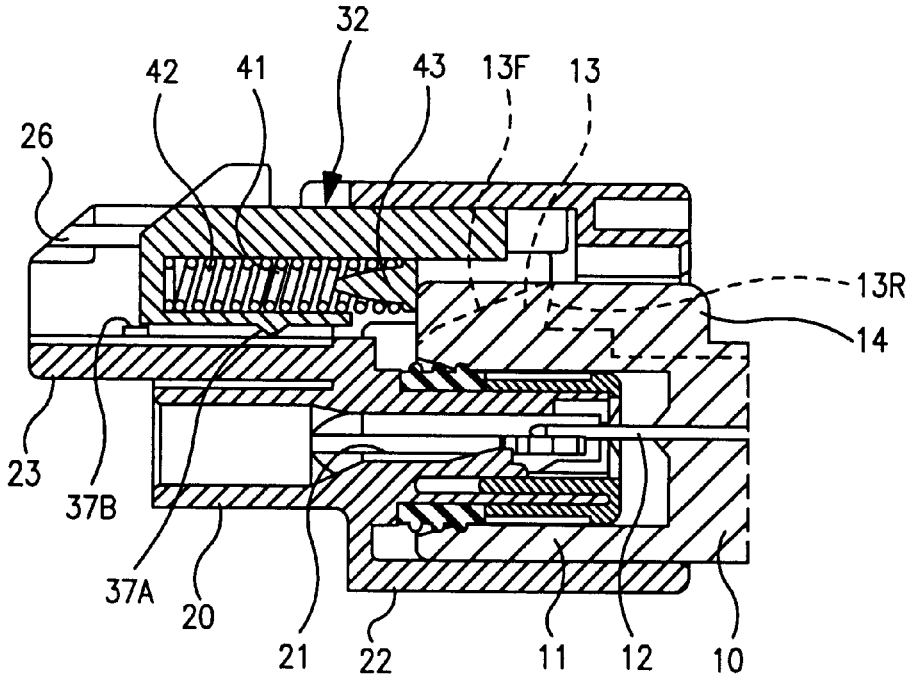
FIG. 2B is a section showing a state of the compression coil springs while the housings are being connected with each other.
Figure 3A:
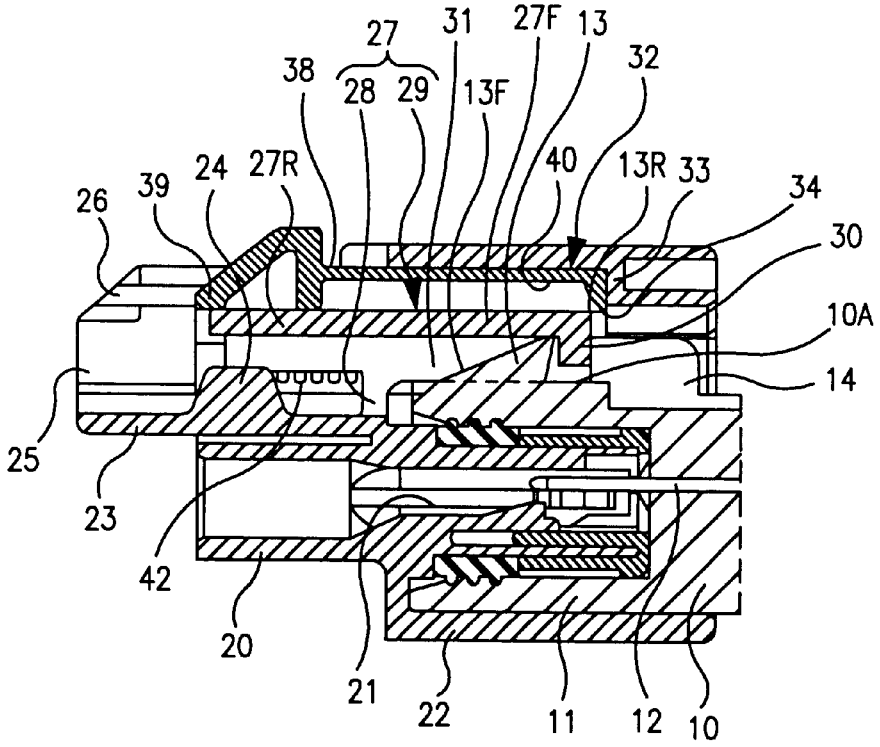
FIG. 3A is a section showing a state of the lock arm when locking by the lock arm is effected.
Figure 3B:
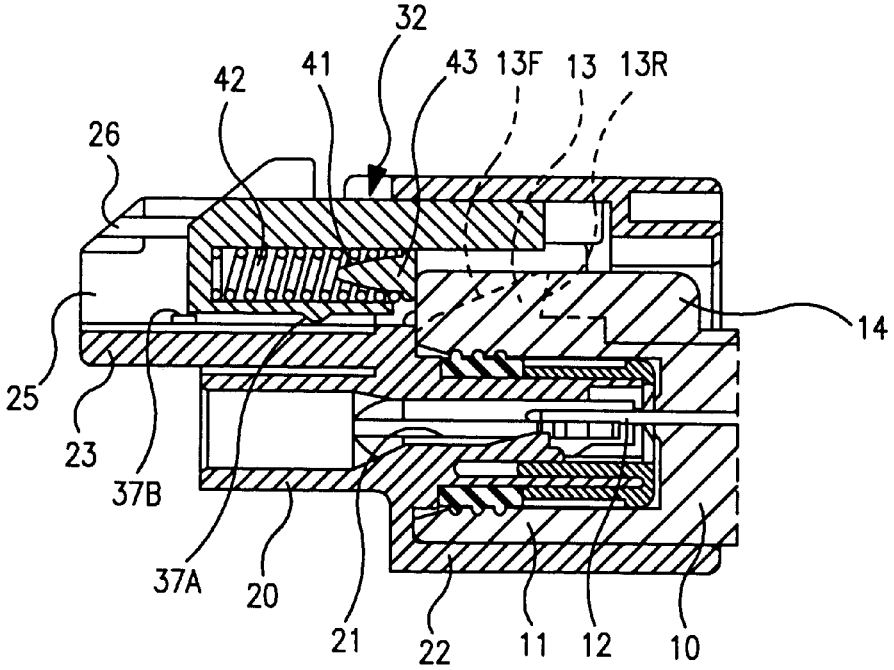
FIG. 3B is a section showing a state of the compression coil springs when locking by the lock arm is effected.

The housings 10 and 20 are connected with each other by first fitting the male housing 10 into the female housing 20 along the inner wall of the engaging portion 22 with the slider 32 held in the displacement permitting position (see FIG. 1). The slanted guide surface 13F of the locking projection 13 then contacts the bottom edge of the lock 30 of the lock arm 27, and the lock 30 slides up on the slanted guide surface 13F. As the lock 30 slides up, the lock arm 27 elastically inclines toward the unlocking position and displaces the locking portion 29F upward, as shown in FIG. 2. When the housings 10 and 20 are connected properly with each other, the lock 30 reaches the top of the locking projection 13 and moves over it. As a result, the lock 30 is disengaged from the upper surface of the locking projection 13 and the lock arm 27 returns substantially to the locking position by the downward movement of the locking arm portion 29F due its elastic restoring force. The returning movement of the lock arm 27 causes the lock 30 to engage the locking surface 13R of the locking projection 13 from behind, as shown in FIG. 3. As a result, the housings 10 and 20 are locked together.

When the lock arm 27 is returned to the locking position, the lower surfaces of the striking portions 31 forcibly strike upon or contact the upper surface 10A of the male housing 10 due to the elastic restoring force of the lock arm 27, thereby producing a large striking sound. This striking sound enables an operator to know that locking by the lock arm 27 has been effected.

The front ends of the pushing portions 14 of the male housing 10 contact and elastically compress the coil springs 42 as the connection of the housings 10 and 20 progresses. Immediately before the housings 10 and 20 are connected properly, the male housing 10 engages and displaces the elastic holding piece 35 in the disengaging direction from the receiving portion 36. As a result, the slider 32 is released from a state where its backward movement is prevented by the elastic holding piece 35, and the slider 32 is moved backward from the displacement permitting position to the displacement restricting position by biasing forces of the coil springs 42, as shown in FIG. 4. Consequently, the restricting projection 34 of the slider 32 contacts the upper surface of the locking portion 29F of the lock arm 27 to prevent the lock arm 27 from being inclined toward the unlocking position. In this way, the connecting operation of the housings 10 and 20 is completed.

The connecting operation conceivably could be interrupted before the housings 10 and 20 are connected properly. In this situation, the male housing 10 is pushed out of the female housing 20 by the elastic restoring forces of the coil springs 42 that had been compressed by the pushing portions 14, and hence the male housing 10 is separated from the female housing 20. Thus, the housings 10 and 20 are not left in a partly connected state.

The housings 10 and 20 can be separated from their properly connected state by moving the slider 32 from the displacement restricting position forward to the displacement permitting position against the biasing forces of the coil springs 42. The rear end of the flexible wall 38 then is pushed down. The pushing portion 39 then pushes the unlocking portion 29R of the lock arm 27 down, thereby inclining the lock arm 27 to the unlocking position, and displacing the lock 30 up to a position higher than the upper end of the locking projection 13. As a result, unlocking is effected. The elastic restoring forces of the coil springs 42 then act on the pushing portions 14 of the male housing 10 to push the male housing 10 out of the female housing 20. As a result, the housings 10 and 20 are separated from each other.

As explained above, the downward projecting distance or width W1 of the locking portion 30 is set such that the lock 30 engages only substantially the upper half of the locking surface 13R of the locking projection 13. As a result, a degree of inclining displacement of the lock arm 27 when the locking portion 30 moves over or interacts with the locking projection 13 can be suppressed to a low level. This enables a reduction in connection resistance resulting from the elastic restoring force of the lock arm 27.

The reduction of the displacement of the lock arm 27 enables a reduction in the height of the deformation permitting space 40. Thus, the height of the female housing 20 as a whole can be reduced. Further, a vertical stroke of the flexible wall portion 38 upon being pushed and an operational resistance resulting from the elastic restoring force of the lock arm 27 are reduced when locking by the lock arm 27 is released. Thus, an excellent unlocking operability can be provided.

The locking portion 30 with its reduced downward projecting distance has no function of producing a sound due to its strike upon the upper surface 10A of the male housing 10. Rather, the striking portions 31 are formed separately from the locking portion 30 to produce a striking sound. Consequently, a vertical dimension of the engaging area of the locking portion 30 with the locking projection 13 can be reduced while securely producing a striking sound.

A single striking portion 31 at the left or right side of the lock arm 27 may generate a twisting deformation at the time of striking. However, two striking portions 31 are symmetrical on the lock arm 27 in this embodiment. Thus the lock arm 27 will not undergo a twisting deformation at the time of striking.

The striking portions 31 are continuous with the left and right side edges of the locking portion 30. Thus, rigidity of the locking portion 30 against a pushing force acting in forward and backward directions can be enhanced. Accordingly, even if the locking portion 30 is pushed from behind from the side of the locking projection 13 upon the action of a force for separating the housings 10 and 20 from each other, deformation of the locking portion 30 is prevented to assure a very reliable locking function.

The present invention is not limited to the above embodiments. For example, following embodiments are also embraced by the technical scope of the invention as defined in the claims. Besides these embodiments, various changes can be made without departing from the scope and spirit of the invention as defined in the claims.

Although the striking portions are laterally symmetrical in the foregoing embodiment, only one of them may be formed provided.

Although the striking portions are continuous with the locking portion at their front ends in the foregoing embodiment, the striking portions and the locking portion may be separate according to the present invention.

In the foregoing embodiment, the lock arm has the locking portion and the unlocking portion projecting in opposite directions from the legs and is displaceable like a seesaw. However, the present invention is also applicable to a lock arm that extends in one direction from the leg portion.

What is claimed is:

1. A connector, comprising:

first and second housings that are connectable with each other;

a locking projection formed on the first housing;

an elastically deformable lock arm formed on the second housing;

a lock projecting from the lock arm a selected projecting distance and disposed for interfering with and moving on the locking projection during connection of the housings, such that movement of the lock on the locking projection resiliently deflects the lock arm, the lock arm being elastically restored when the housings are connected properly with each other, such that the lock engages the locking projection to lock the housings together; and at least one striking portion disposed in a position on the lock arm to avoid interference with the locking projection, the striking portion projecting from the lock arm a distance greater than the projecting distance of the lock, such that elastic restoring forces of the lock arm cause the striking portion to strike the first housing when the housings are connected properly with each other.

2. A connector according to claim 1, wherein the at least one striking portion is formed in a position different from the lock.

3. A connector according to claim 1, wherein two striking portions are formed substantially symmetrically with respect to a longitudinal axis of the lock arm.

4. A connector according to claim 1, wherein the striking portion is substantially continuous with the lock.

5. A connector according to claim 1, wherein the projecting distance of the lock is set such that the lock arm interacts only with an upper portion of the locking projection thereby reducing a degree of inclination of the lock arm when the lock interacts with the locking projection.

6. A connector according to claim 1, further comprising a slider movably disposed in the second housing for restricting a movement of the lock arm when the slider is in a displacement restricting position, the slider allowing movement of the lock arm when the slider is in a displacement permitting position.

7. A connector according to claim 6, wherein the slider has a flexible wall for contacting the lock arm and effecting an unlocking of the lock arm, when the slider is in the displacement permitting position and when the housings are connected properly.

8. A connector according to claim 7, further comprising biasing means for biasing the housings in a disengaging direction with respect to each other.

* * * * *